United States Patent [19]

Hosokawa et al.

[11] Patent Number: 4,620,422

[45] Date of Patent: Nov. 4, 1986

[54] PROCESS FOR THE PRODUCTION OF PROCESSED ICE CONTAINING SOLUBLE ADDITIVES OR MATERIALS DISPERSED THEREIN

[75] Inventors: Hidehiro Hosokawa, Yokohama; Yoshimichi Iida, Saitama; Hisatsugu Takahashi, Chiba, all of Japan

[73] Assignee: Nichirei Corporation, Tokyo, Japan

[21] Appl. No.: 757,855

[22] Filed: Jul. 22, 1985

[30] Foreign Application Priority Data

Jul. 31, 1984 [JP] Japan ..... 59-158670

[51] Int. Cl.[4] ..... F25C 1/18

[52] U.S. Cl. ..... 62/70; 62/308; 62/356

[58] Field of Search ..... 62/69, 70, 307, 308, 62/356

[56] References Cited

U.S. PATENT DOCUMENTS

| | | | |
|---|---|---|---|
| 1,160,945 | 11/1915 | Murphy | 62/307 X |
| 1,961,889 | 6/1934 | Martocello, Sr. | 62/70 |
| 2,723,534 | 11/1955 | Wilbushewich | 62/308 X |
| 3,959,981 | 6/1976 | Anderson | 62/70 X |
| 4,217,762 | 8/1980 | Sakamoto et al. | 62/70 X |

*Primary Examiner*—William E. Tapolcai

*Attorney, Agent, or Firm*—Wenderoth, Lind & Ponack

[57] ABSTRACT

Ice, in particular, block ice containing soluble materials dispersed therein is produced in an effective manner on a commercial scale by a process comprising cooling and freezing raw water for ice making in an ice can while air blowing and agitating by a blowing means, characterized by adding and dissolving soluble additives or materials in the raw water, effecting the air blowing and agitating with air under a pressure close to a minimum pressure required for dispersing bubbles in the raw water and thereby dispersing and incorporating the soluble additives or materials in the ice without substantially deteriorating the transparency of the ice.

12 Claims, 2 Drawing Figures

PROCESS FOR THE PRODUCTION OF PROCESSED ICE CONTAINING SOLUBLE ADDITIVES OR MATERIALS DISPERSED THEREIN

BACKGROUNG OF THE INVENTION

1. Field of the Invention

This invention relates to a process for producing ice containing a soluble additive or material dispersed therein and more particularly, it is concerned with a process for producing processed ice containing a soluble additive or material such as coloring agents, flavors, alkali ions, sweetening agents, seasonings and salt, and having enlarged applications.

2. Description of the Prior Art

For large-sized ice commercially available in the form of a block ice or square pillar ice, in general, its transparency is very important for estimation of the quality, because it is known by experience that the transparency is a standard of purity that is backed up by analytical results.

On the other hand, production of a large-sized block ice has been carried out by charging ice making raw water fit to drink in a large square ice can, dipping the ice can in a cooling brine tank, and cooling the raw water continuously for several days, thereby advancing freezing gradually from the inner wall of the ice can to the inside and finally freezing the central part. When this freezing is naturally advanced without any treatments, gases or salts dissolved in the raw water for ice making are sealed in the ice crystals of the block ice, resulting in a white ice block which is not suitable for marketing.

In an apparatus of the prior art as shown in FIG. 1, drop tube 4 for feeding air to agitate raw water 5 for ice making is arranged in ice can 6 and air is always fed into raw water 5 for ice making from the end of drop tube 4 to form air bubbles. Utilizing the vibration or convection of water formed when the air bubbles rise through raw water for ice making, the inner surface of ice layer 7 is prevented from adhesion of gaseous fine bubbles, dissolved materials or ions and these are allowed to remain in non-frozen water 8 or to diffuse in the air. When the freezing further proceeds and impurities are concentrated at the central non-frozen part, the water of the central part is exchanged with fresh water and the freezing is further continued to complete it, thereby producing large-sized transparent block ice.

In the production of transparent ice according to the prior art, when soluble materials or ingredients such as coloring agents, flavors and sweetenings are added and dissolved in raw water for ice making, and subjected to ice making so as to disperse and incorporate the soluble ingredients in the transparent ice, it has been impossible to incorporate the soluble materials therein, since substantial amounts of the soluble materials are removed from the ice like the above described impurities. Thus, it has been proposed to produce a uniformly colored block ice by the use of raw water containing a stabilizer (Japanese Patent Publication No. 19976/1985).

SUMMARY OF THE INVENTION

It is an object of the present invention to provide a process for producing processed ice, in particular, semi-transparent block ice containing soluble materials or additives dispersed therein, for example, soluble coloring agents, flavors, alkali ions, minerals, sweetenings, salt or chemical seasonings.

It is another object of the present invention to provide a process for the production of semi-transparent block ice in an effective manner on a commercial scale.

These objects can be attained by a process for the production of processed ice containing soluble additives or materials dispersed therein, comprising cooling and freezing raw water for ice making in an ice can while blowing air into the agitating the raw water by means of a blower for agitating the raw water, characterized by adding and dissolving soluble additives or materials in the raw water, effecting the air blowing and agitating with air under a pressure of near a minimum pressure required for dispersing bubbles in the raw water and thereby dispersing and incorporating the soluble additives or materials in the ice without deteriorating the transparency of the resulting ice to a large extent.

BRIEF DESCRIPTION OF THE DRAWINGS

The accompanying drawing illustrate the principle and merits of the present invention in detail.

DETAILED DESCRIPTION OF THE INVENTION

The inventors have made various efforts to allow the above described soluble materials to disperse in the ice without substantially deteriorating the transparency thereof, and consequently have found that when the pressure of air fed into raw water for ice making is decreased and ice making is carried out under a critical state where bubbles can effectively be dispersed, the soluble materials are dispersed and contained in semi-transparent ice, and these soluble materials must be so held that their effects are not diminished by chemical changes until the ice making is completed. The present invention is based on this finding.

Accordingly, the present invention provides a process for the production of processed ice containing soluble additives or materials dispersed therein, comprising cooling and freezing raw water for ice making in an ice can while blowing air into and stirring the raw water by means of a blower for stirring the raw water, characterized by adding and dissolving soluble additives or materials in the raw water, effecting the air blowing and stirring with air under a pressure close to a minimal pressure required for dispersing bubbles in the raw water and thereby dispersing and incorporating the soluble additive or materials in the ice without deteriorating the transparency of the resulting ice to a large extent. In this process, processed ice can be produced in a more effective manner by keeping the space between the ice can and a part of the air blowing means for stirring the raw water, i.e. drop tube, electrically insulated, or by making both the ice can and air blowing means out of metallic materials capable of holding the same electric potential between them, preferably the same metallic material.

Figure 2:
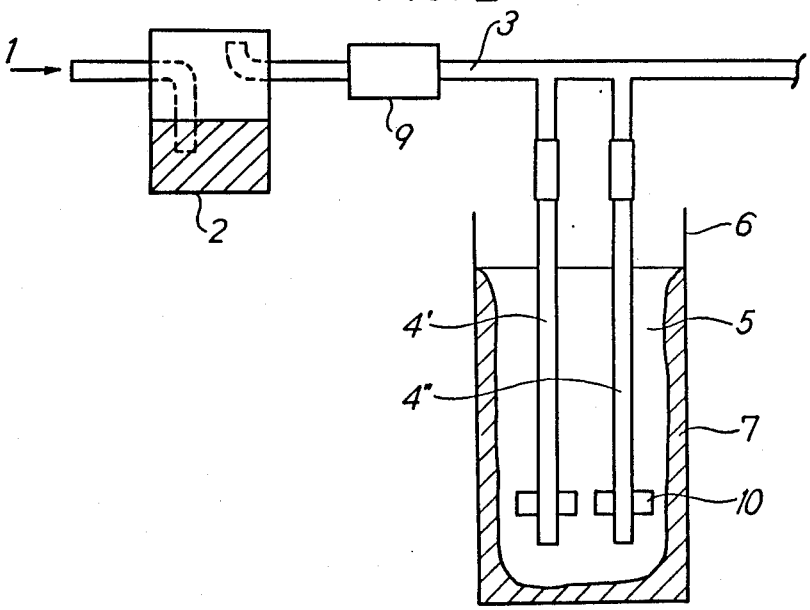
FIG. 2 is a schematic view of one embodiment of the ice making apparatus according to the present invention to show the interior of the principal parts.

When a processed ice containing water-soluble additives or materials dispersed therein is produced according to the process of the present invention, it is preferable to use an apparatus for ice making as shown in FIG. 2.

Referring to FIG. 2, air 1 supplied from a compressed air tank (not shown) or air compression pump (not shown) is subjected to removal of lubricating oils and finely divided dusts in washing tank 2 and after the pressure of the air is adjusted to a pressure of approximately near a minimal pressure required for dispersing bubbles in raw water for ice making by pressure control valve 9, air 1 is introduced into raw water 5 for ice making from drop tubes 4' and 4''. Drop tubes 4' and 4'' are provided with air rectifying vanes 10 so that bubbles introduced into raw water 5 are allowed to go up near ice layer 7.

In the production of processed ice containing soluble additives and materials according to the present invention, the soluble additives or materials are added and dissolved in water to prepare raw water for ice making, and this raw water 5 is charged in ice can 6, in which drop tubes 4' and 4'' connected via air feed pipe 3 with pressure control valve 9, air washing tank 2 and the compressed air tank or air compression pump are inserted, and which is set into a cooling brine tank. While adjusting the pressure of air 1 from the compressed air tank or air compression pump to a pressure of approximately a minimal pressure required for dispersing bubbles in raw water 5, i.e. 0.15 to 0.23 kg/cm$^2$ (Gauge), preferably 0.18 to 0.2 kg/cm$^2$ (Gauge) by pressure control valve 9, air 1 is introduced into raw water 5 from drop tubes 4' and 4'' and cooling is continued substantially for 2 days and nights with air blowing and agitating raw water 5, thus freezing raw water 5. In this ice making process, drop tubes 4' and 4'' are gradually lifted with the growth of ice layer 7 and finally lifted completely. The ice making is thus completed.

Drop tubes 4' and 4'' are to the ends thereof provided with air rectifying vanes 10 each having a suitable size, by which the air introduced into raw water 5 for ice making from the ends of drop tubes 4' and 4'' is finely divided and allowed to go up at a position near grown ice layer 7 to agitate raw water 5 very quietly. By this air blowing and agitation, salts adhered to the surface of the grown ice crystal can be removed to some extent, and only larger bubbles formed on the surface ice layer 7 with the progress of freezing can be removed. The residual smaller bubbles make among ice crystals small spaces in which soluble additives or materials dissolved in raw water are incorporated, so the resulting semi-transparent ice contains the dispersed soluble additives or materials.

As the soluble additives or materials to be added and dissolved in raw water for ice making, there can be used any of materials which can be used for food, for example, water-soluble coloring agents, water-soluble flavors, alkali ions, water-soluble sweetening agents, water-soluble minerals, salt and water-soluble chemical seasonings. In particular, calcium hydroxide, coloring agents for food and flavors for food are preferably used as the water-soluble additives. For example, calcium hydroxide is preferably added to raw water in a proportion of 6 g/l, a coloring agent for food, BW in a proportion of 2.8 g/l and a food flavor, Champagne Cider Essence in a proportion of 7.5 ml/l.

For ice can 6 in which raw water 5 is cooled and frozen by a cooling brine from the outside, a higher conduction of heat is required. Accordingly, ice can 6 is ordinarily made of metals, for example, galvanized steels or stainless steels, while drop tubes 4' and 4'' are also made of metals, for example, aluminum, galvanized iron, stainless steels or plastics. When ice can 6 and drop tubes 4' and 4'' are made of different metals, for example, galvanized iron and stainless steel, or galvanized iron and aluminum in combination, however, there sometimes occurs a polarization potential between the different metals, thus resulting in not only ionic migration in the raw water, but also chemical change of the soluble additives or materials dispersed in the raw water. Thus, it is preferable, for example, to coat drop tubes 4' and 4'' with a plastic film or to make drop tubes 4' and 4'' of a plastic, thereby electrically insulating the space between ice can 6 and drop tubes 4' and 4'', or to make ice can 6 and drop tubes 4' and 4'' of the same metal, thereby causing no polarization potential between them.

In some cases, such an electrical insulation can be obtained by ice layer 7 between drop tubes 4' and 4'' and ice can 6 when ice can 6 is charged with raw water 5 and dipped in a cooling brine tank to form a thin ice layer 7 on the inside wall of ice can 6 before drop tubes 4' and 4'' are inserted in ice can 6, and then drop tubes 4' and 4'' are inserted in raw water 5 for ice, followed by ice making with air blowing and agitating.

According to the present invention, therefore, ice containing soluble additives or materials such as soluble coloring agents, flavors, alkali ions, minerals, sweetening agents, salt, chemical seasonings and the like can be produced a more effective manner on a commercial scale.

The following examples are given in order to illustrate the present invention in greater detail without limiting the same.

EXAMPLE 1

In an apparatus for ice making as shown in FIG. 2, there were used ice can 6 made of galvanized iron, the upper part of which was somewhat enlarged, i.e. having an opening dimension of 290×570 mm, bottom dimension of 265×545 mm and depth of 1120 mm, and drop tubes 4' and 4'' made of stainless steel, having an inner diameter of 5 mm and length of 600 mm, the outer surface of which was covered with a polyethylene film.

0.05 g/l of calcium hydroxide was added to a city water containing 18.2 ppm of calcium ion and having an electroconductivity of 135 μs/cm to prepare raw water for ice making. 140 l of this raw water was charged in the ice can 6, which was then dipped in a cooling brine cooled to −9° C. Drop tubes 4' and 4'' as described above were lowered in the raw water and freezing operation was continued while introducing air under a pressure of 0.18 to 0.2 kg/cm$^2$ (Gauge) therein for 2 days and nights, thus obtaining 135 kg of a completely frozen block ice, which was semi-transparent but favourably compared with that of the prior art, as obtained in the following Comparative Example, as a commercial article.

Comparative Example

Figure 1:
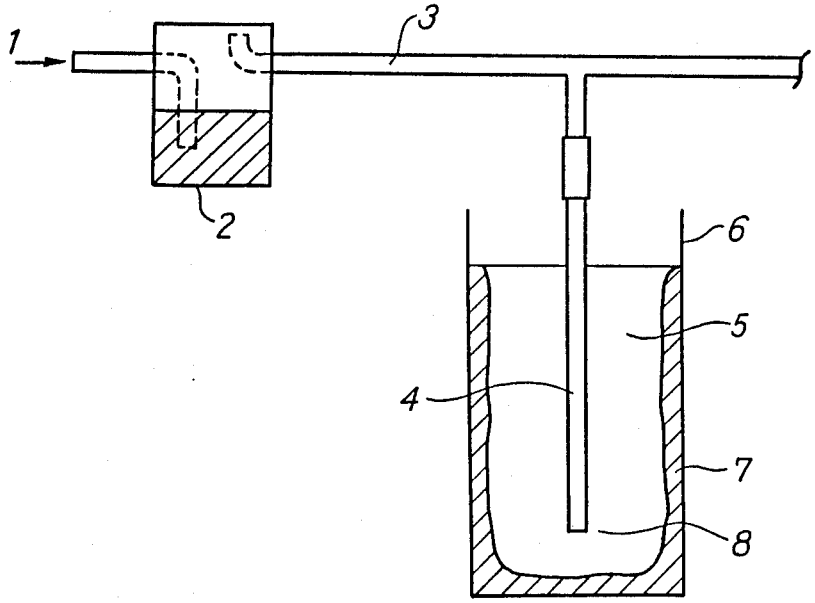
FIG. 1 PRIOR ART
FIG. 1 is a schematic view of an ice making apparatus according to the prior art to show the interior of the principal parts.

In an apparatus for ice making as shown in FIG. 1, there were used ice can 6 made of galvanized iron the upper part of which was somewhat enlarged, i.e. having an opening dimension of 290×570 mm, bottom dimension of 265×545 mm and depth of 1120 mm, and drop tube 4 made of stainless steel, having an inner diameter of 5 mm and length of 600 mm.

A city water containing 18.2 ppm of calcium ion and having an electroconductivity of 135 μs/cm was used as the raw water for ice making. 140 l of this raw water was charged in the ice can 6, which was then dipped in a cooling brine liquor cooled to −9° C. The drop tube 4 was lowered in the raw water and freezing operation was continued for 2 days and nights while introducing air under a pressure of 0.25 to 0.3 kg/cm$^2$ (Gauge), thus obtaining 135 kg of completely frozen block ice.

The waters obtained by melting the block ice of the Example and that of the Comparative Example have properties as shown in Table 1, from which it will be apparent that in spite of the fact that the block ice obtained in the Example contains calcium ion in a greater amount than that obtained in the Comparative Example, the transparency of the former is in an allowable range as a commercial article.

TABLE 1

| | Example | Comparative Example |
|---|---|---|
| Calcium Ion (ppm) | 14.6 | 0.05 |
| pH | | |
| Electroconductivity (μs/cm) | 48 | 1.6 |

EXAMPLE 2

The procedure of Example 1 was repeated except using an ice can made of stainless steel and a drop tube made of the same stainless steel, thus obtaining a completely frozen block ice with substantially similar properties to that of Example 1.

What is claimed is:

1. A process for producing processed ice containing soluble additives or materials dispersed therein, which comprises adding and dissolving soluble additives or materials in raw water for ice making in an ice can, and cooling and freezing the raw water while blowing air into the raw water from a blowing means and agitating the raw water with air, wherein the air is under a pressure close to a minimum pressure required for dispersing bubbles in the raw water, thereby dispersing the soluble additives or materials in the ice without substantially deteriorating the transparency of the resulting ice.

2. The process of claim 1, wherein there is a space between the ice can and a part of the blowing means and the space is held electrically insulated.

3. The process of claim 1, wherein the ice can and blowing means are made of metallic material and the electric potential between the ice can and blowing means is held at the same potential.

4. The process of claim 3, wherein the metallic material of the ice can is the same as the metallic material of the blowing means.

5. The process of claim 1, wherein the ice can is made of a metal selected from the group consisting of galvanized iron and stainless steel.

6. The process of claim 1, wherein the blowing means comprises at least one drop tube.

7. The process of claim 6, wherein the drop tube is made of a material selected from the group consisting of aluminum, galvanized iron, stainless steel and plastic.

8. The process of claim 6, wherein the drop tube is a plastic film-coated tube.

9. The process of claim 1, wherein the air blowing and agitating are carried out by introducing air under a pressure of 0.15 to 0.23 kg/cm$^2$ (Gauge).

10. The process of claim 6, wherein the drop tube is connected to a system for air blowing and agitating the raw water, comprising a pressure control valve.

11. The process of claim 6, wherein the drop tube is provided with at least one air rectifying vane.

12. The process of claim 1, wherein the soluble additives or materials are selected from the group consisting of coloring agents, flavors, alkali ions, minerals, sweetening agents, salt, chemical seasonings and mixtures thereof.

* * * * *